US005897267A

United States Patent [19]

Poolman et al.

[11] Patent Number: 5,897,267

[45] Date of Patent: Apr. 27, 1999

[54] ROLL-ON APPLICATOR

[75] Inventors: Gerard Charles Poolman, Strombeek-Bever; Patrick Jean-François Etesse, Brussels; Richard Mark Baginski, Overijse, all of Belgium; Mathias Prox, Frechen, Germany

[73] Assignee: The Procter & Gamble Company, Cincinnati, Ohio

[21] Appl. No.: 08/836,633

[22] PCT Filed: Oct. 27, 1995

[86] PCT No.: PCT/US95/14014

§ 371 Date: May 16, 1997

§ 102(e) Date: May 16, 1997

[87] PCT Pub. No.: WO96/15694

PCT Pub. Date: May 30, 1996

[30] Foreign Application Priority Data

Nov. 18, 1994 [EP] European Pat. Off. ..... 94870179

[51] Int. Cl.[6] ..... B43K 7/10

[52] U.S. Cl. ..... 401/214; 401/213; 401/209; 401/208

[58] Field of Search ..... 401/214, 213, 401/208, 209

[56] References Cited

U.S. PATENT DOCUMENTS

| | | | |
|---|---|---|---|
| 2,663,891 | 12/1953 | Hanryon | 401/214 |
| 2,807,817 | 10/1957 | Ackerman | 401/213 |
| 2,930,062 | 3/1960 | Reimann | 401/214 |
| 2,968,826 | 1/1961 | Leshin | 401/214 |
| 3,103,691 | 9/1963 | Stull | 401/213 |
| 3,336,626 | 8/1967 | Schaich | 15/572 |
| 4,002,411 | 1/1977 | Harbauer | 401/213 |
| 4,198,172 | 4/1980 | Meislik | 401/214 |

FOREIGN PATENT DOCUMENTS

| | | | |
|---|---|---|---|
| 2168921 | 7/1986 | United Kingdom | B29C 55/12 |

*Primary Examiner*—Henry J. Recla
*Assistant Examiner*—Tuan Nguyen
*Attorney, Agent, or Firm*—R. M. Young

[57] ABSTRACT

The present invention relates to a roll-on applicator with a filling opening and a dispensing opening which prevents leakage or spillage without the need of the cooperation of a cap. This container comprises ball (3) and a flexible and resilient support means (4) for said ball. Said flexible and resilient support means urges said ball against said dispensing opening, achieving a leak-tight engagement between said ball and said dispensing opening. Furthermore, said flexible and resilient support means can be resiliently deformed by an external force acting on said ball to disengage said leak-tight engagement between said ball and said dispensing opening, allowing said contained product to be spread by said ball.

10 Claims, 3 Drawing Sheets

ROLL-ON APPLICATOR

FIELD OF THE INVENTION

The present invention relates to a roll-on applicator. The roll-on applicator according to the present invention is particularly adapted for pretreatment of fabrics with a portion of liquid detergent.

BACKGROUND OF THE INVENTION

Roll-on applicators are well known in the art. Usually, said applicators are containers comprising a hollow body for liquids, a ball and a retaining support means for said ball. These roll-on applicators generally allow to apply a liquid film from the inside of the hollow body to a selected surface. The common problem of these is to avoid leakage or spillage of the contained liquid during the periods of non-use of said roll-on applicators. The prior art solves this problem using the cooperation of a cap. Indeed, as disclosed in U.S. Pat. No. 3,036,328, U.S. Pat. No. 4,221,494, U.S. Pat. No. 4,221,495, U.S. Pat. No. 4,475, 837 and U.S. Pat. No. 5,051, 017, the ball is forced to engage and bear against a sealing surface of said retaining support means when the container is closed by the cap. But this solution to avoid leakage or spillage is inconvenient, if the above retaining support means with the ball is located under the level of the content. Indeed, leakage or spillage may occur during the operation of unscrewing the cap. For this reason, the roll-on applicator of the prior art usually has the retaining support means for the ball on top of the corresponding container above the level of the content when said container is stored in its upright position.

EP-A-0 575 714, for example, describes a circular-sectioned applicator rotating about the axis defined by opposite pins engaged in the rim of an orifice. The liquid detergent has to be poured through the orifice before being intercepted by said applicator. Therefore, leakage or spillage is prevented only by the fact that said orifice is located above the level of the contained liquid detergent. This example shows that in the art of roll-on applicating means exists the need of a leakage- or spillage-free solution ensured without a cap.

It is an object of the present invention to provide a container with a roll-on applicating means which is leak-tight when the cap is off or when said container does not comprise a cap and when the liquid is above said roll-on applicating means.

Another disadvantage of the roll-on applicators of the prior art is given by the fact that the spread quantity cannot be increased. Instead, the prior art only teaches a decrease of said spread quantity. Indeed, the roll-on applicating means described in the above mentioned prior art can force the ball to engage and bear against a sealing surface of said retaining support means to decrease or stop completely the flow of the content on said ball. The inverse is never possible. On the contrary, an increased spread quantity is useful especially during pretreatment. Indeed, different stains may need a greater amount of liquid detergent for a more effective pretreatment. For example, stains made of certain constituents may need a greater quantity of detergent to get a more thorough and effective pretreatment. A greater quantity may also be needed to simply cover the dimension of the stain itself.

It is therefore an object of the present invention to provide a container with roll-on applicating means allowing to increase the product flow from the interior.

SUMMARY OF THE INVENTION

The present invention is a container (10) adapted to contain and dispense a product. Said container comprises a hollow body (1), a dispensing opening (2), a ball (3) and a flexible and resilient support means (4) for said ball. Said flexible and resilient support means urges said ball against said dispensing opening, achieving a leak-tight engagement between said ball and said dispensing opening. Said flexible and resilient support means can be deformed in a resilient manner by an external force acting on said ball whereby said leak-tight engagement between said ball and said dispensing opening is disengaged, allowing said contained product to be spread by said ball.

DETAILED DESCRIPTION OF THE INVENTION

An embodiment of the present invention is shown in a cross sectional view in FIG. 1. The present invention provides a container (10) (only partially shown in FIG. 1) adapted to contain and dispense a product. The word "container" encompasses any form and/or type of containers comprising a hollow body (1) and a dispensing opening (2). For example, bottles, tubes, dosing and/or dispensing devices are containers according to the definition of the present invention. Said dispensing opening (2) of container (10) may be closed by a cap. The hollow body (1) of the container may be made of a rigid, soft or flexible material. Soft or flexible materials may be preferred to allow squeezing of the hollow body itself for a further controlled dispensing through the opening. Specifically for dosing and/or dispensing devices, said hollow body may be preferably made of a material resistant to water, temperature (up to 95° C.).

Specifically, said dosing and/or dispensing devices are adapted for pretreatment of fabrics, like, for example, the one described in WO 92/09736 and/or WO 92/09736. Usually, said dosing and/or dispensing device adapted for pretreatment comprises a further opening which allows the filling of this device. When this device is put inside the washing machine with the fabrics, said filling opening also allows the dispensing of the content into the wash liquid of the machine during the wash cycle. The filling opening is usually located on the top of said dosing and/or dispensing device when said device is in its upright position.

Figure 4:
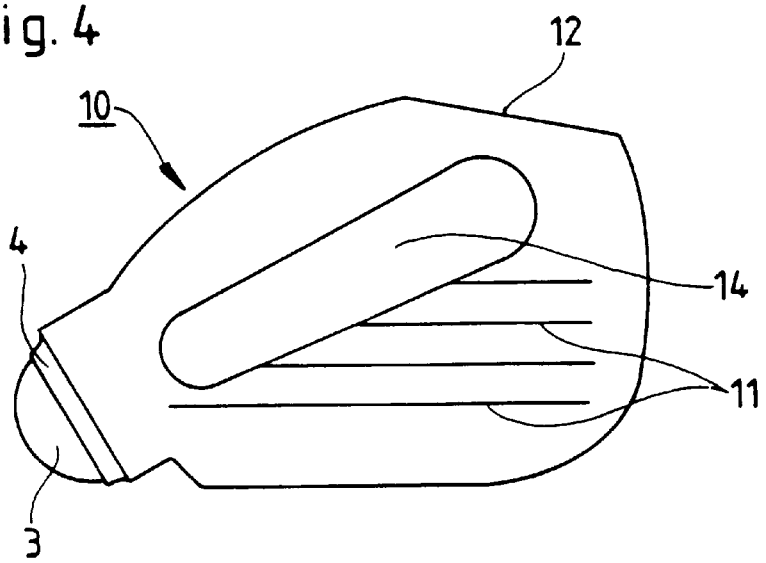
FIG. 4 illustrates the embodiment where the ball of FIGS. 2*b* and 3 is part of a dosing and dispensing device also adapted for pretreatment of fabrics.

A partially or completely transparent hollow body (1) is a preferred option to allow the user to verify the quantity of the content and facilitate measuring and dosing with dosing and/or dispensing devices. As another preferred option, said hollow body may further comprise at least one dosing line on the external and/or internal surface of said hollow body (FIG. 4, 11). Preferably, said container is made of a plastic material, such as, for example, polypropylene, polyethylene, polyurethane or polyvinyl chloride.

The container (10) may be adapted to contain liquid substances. Preferably, said product is a liquid detergent.

According to the present invention the liquid detergent may comprise any ingredients known in the art. Such ingredients may include surfactants, suds suppressors, bleaches, chelants, builders, enzymes, fillers and perfumes.

An essential feature of the present invention is a ball (3). Said ball is located partially inside said hollow body (1) at the dispensing opening (2), i.e. said ball protrudes at last partially from said dispensing opening. The dimensions of said ball and said dispensing opening are tuned to each other so that the ball is not normally able to escape through said dispensing opening to the exterior of said hollow body. In use, the content of said container is spread by said ball, since said ball is always in communication with the content of said container (10). In use, part of the content gets in contact with said ball and is then applied onto a surface outside said container by rotation of said ball.

Said ball (3) may be hollow or solid, and may have a generally smooth outer surface or may have an outer surface having some degree of roughness. Said ball may be made of an open or closed celled structure. Preferably, said ball is rigid. The use of a spherical ball permits an omnidirectional spreading, since a spherical ball will rotate in any direction with equal efficacy. Other shapes of said ball may be utilized, such as, for example, cylindrical or ellipsoidal. But such shapes may present functional limitations in that balls of that shapes will only generally rotate about a single axis. Preferably, the present invention uses spherical balls to allow an omnidirectional spreading. We found that this feature is particularly useful to achieve an accurate and comfortable spreading of liquid detergent during pretreatment, regardless of the patterns of stains. On the contrary, if the ball was limited to rotate around one axis, the user would be obliged to perform complicated movements with his hand, like twisting the wrist. The spreading with an omnidirectional rotating ball is also better controlled, and therefore avoids waste of liquid detergent, since it is easier to spread only on the limited area of the stain.

Specifically for dosing and/or dispensing devices, said ball may be preferably made of a material resistant to water, temperature (up to 95° C.). For example it is possible to use plastic materials, such as, for example, polyethylene, polypropylene, polyurethane, or polyvinyl chloride.

The ball (3) is manufactured separately from the hollow body (1). This ball can be then inserted through said dispensing opening into said flexible and resilient support means by simply pushing said ball through the lip (9) of said dispensing opening. This is possible, since said lip (9) of said dispensing opening is flexible enough to be at least slightly elastically deformed, since said lip, part of the hollow body or of the flexible and resilient support means, is preferably made of a plastic material. The container (10) can also comprise more than one ball (3), held separately in different dispensing openings (2) or in a common dispensing opening.

The flexible and resilient support means (4) for said ball is another essential feature of the present invention. Said flexible and resilient support means urges said ball (3) against said dispensing opening (2), achieving a tight engagement between said ball and said dispensing opening. Accordingly, said flexible and resilient support means closes the dispensing opening with the cooperation of said ball. In a preferred embodiment, said flexible and resilient support means presses said ball against the most external rim or lip (9) of said dispensing opening. We found that the engagement between said opening (2) and said ball urged by said flexible and resilient support means is leak tight for liquids. Therefore, it is possible to avoid leakage or spillage during the periods of non-use of said container (10) without the cooperation of a cap.

As a preferred option, said lip (9) of said flexible and resilient support means (4) is flexible or deformable. In this manner, the flexible or deformable lip is able to conform to and/or compensate for any imperfection in the shape of said ball, e.g. when said ball does not have a perfect spherical shape. To achieve this, said flexible or deformable lip may be made of a separate material attached to the perimeter of said dispensing opening. Said flexible or deformable lip of said flexible and resilient support means may also be made by co-injecting a flexible or deformable material, like rubber, forming said lip together with a more rigid material for the rest of said flexible and resilient support means. A flexible or deformable lip does not affect the strength and/or structure of said flexible and resilient support means.

Said flexible and resilient support means (4) is able to be resiliently deformed by an external force acting on said ball (3). Accordingly, by pushing said ball to the inside of said container, said leak-tight engagement between said ball and said dispensing opening (2) is disengaged. Consequently, said ball is free to rotate and able to spread the content, since the free passage between said lip (9) and said ball connects the content with the protruding part of said ball. The free passage between said lip (9) and said ball is hereinafter called "product flow passage". The leak-tight engagement is immediately and automatically re-established once the external force stops to push said ball to the inside of said container. Consequently, the product flow passage is closed interrupting the product flow from inside said container. No further feature, like a cap, is necessary to obtain a leak-tight engagement between said ball and said dispensing opening.

The flexible and resilient support means (4) according to the present invention allows to adapt the flow of product from the interior of said container. Indeed, the dimension of the passage between said lip (9) and said ball (3) can be adjusted by the user by varying the external force exerted on said ball. Consequently, the amount of the product flow from the inside of said container can be controlled by varying the dimension of said passage. Specifically, a greater product flow can be achieved by pressing said ball further inside said container. Furthermore, said flexible and resilient support means in combination with a flexible container further allows to dispense or pour directly the product onto a surface by pressing onto said ball and squeezing said flexible container.

We found that the dimension of the passage between said lip (9) and said ball (3) can be varied without changing the displacement of said ball inside said container. Indeed, this may be done by choosing an appropriate relationship between the dimension of the diameter of said dispensing opening (2) at said lip and the dimension of the diameter of said ball. We further found that at a given perimeter of said lip, and pushing said ball inside said container at a constant displacement, a greater product flow passage can be achieved with a ball of greater diameter in respect to a ball of smaller diameter. The same reversed reasoning applies keeping the diameter of the ball constant and varying the perimeter of said lip. Explained in another way, having a smaller ball (or greater perimeter of said lip), a greater displacement of the ball is needed to have the same dimension of the product flow passage in respect to a container with a greater ball (or smaller perimeter of said lip).

This discovery is particularly useful to ensure leak-tightness to the container according to the present invention for liquids of any viscosity. Indeed, for liquids of low viscosity the dimension of the product flow passage does not need to be as great as for liquids of higher viscosity to achieve dispensing of a given quantity of spread product. Therefore, considering the viscosity of the liquid product, the spread quantity can be optimized by defining the relationship lip-ball as described above. Nevertheless, changing the diameter of said ball may necessitate slight adjustments of the dimension of said flexible and resilient support means.

We further found that said product flow passage allows that most of the product not applied onto a surface and remaining on the part of said ball protruding from said dispensing opening is able to return back inside said container. Otherwise, without a space defined by said product flow passage, this rest-product would be scraped off by the edge of said lip remaining outside and around said dispensing opening. Therefore, said product flow passage of the roll-on applicator according to the present invention considerably reduces waste and messiness of product during use.

Figure 1A:
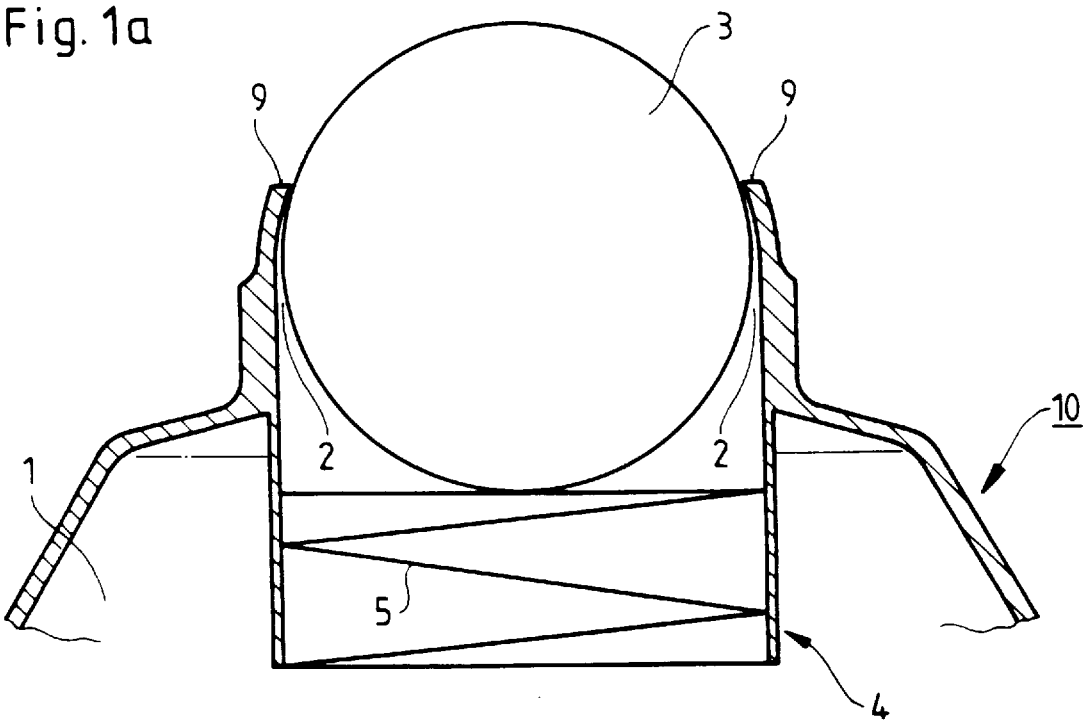
FIGS. 1*a* and 1*b* show a container (shown partially) with an embodiment of the flexible and resilient support means for a ball according to the present invention in a cross sectional view.
Figure 1B:
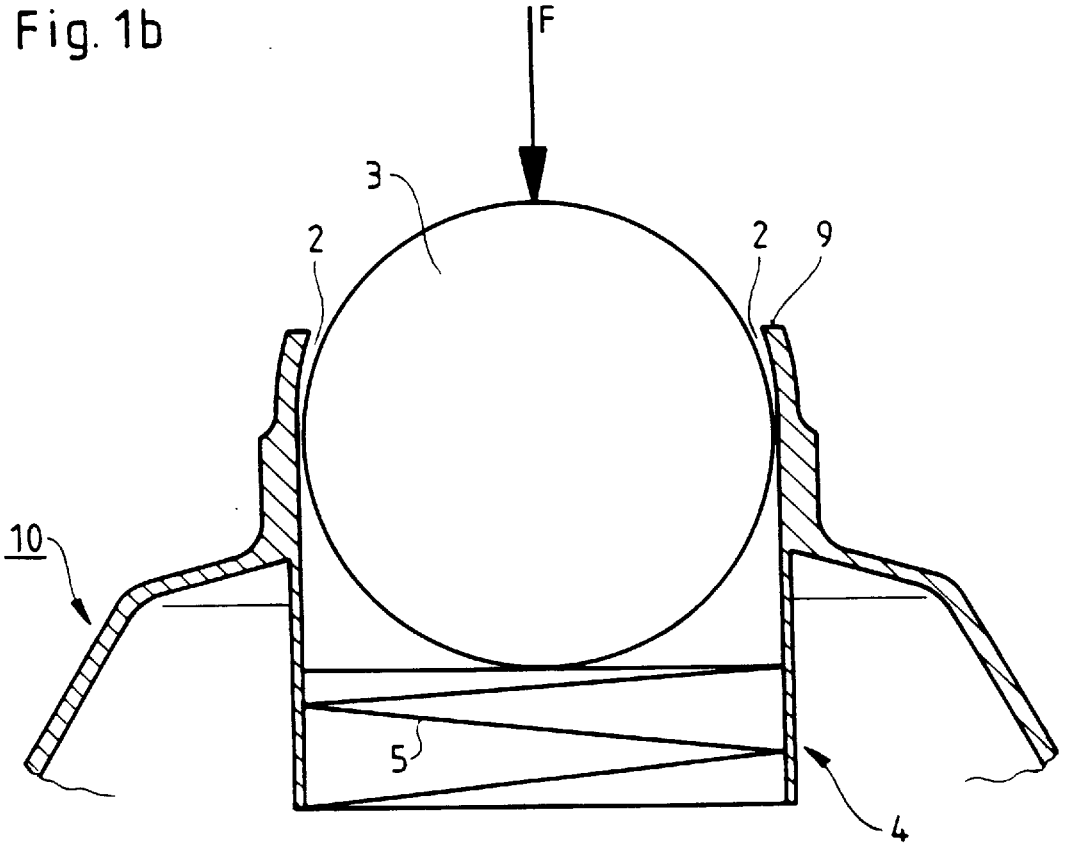

FIG. 1*a* shows an embodiment according to the present invention. Said flexible and resilient support means (4) comprises a spring (5) located under said ball (3). Said spring presses said ball (3) against said dispensing opening (2) to achieve-said leak-tight engagement during the periods of non-use of said container. By exerting a force F on said ball towards the inside of said container, said spring resiliently deforms and the desired product flow passage is created, as shown in FIG. 1*b*. Said spring may be separately attached or an integral part of said hollow body (1). Furthermore, said spring may be made of any possible material, such as, for example, metal or plastic. Said spring may have any possible shape, such as, for example, helical or cylindrical.

Figure 2A:
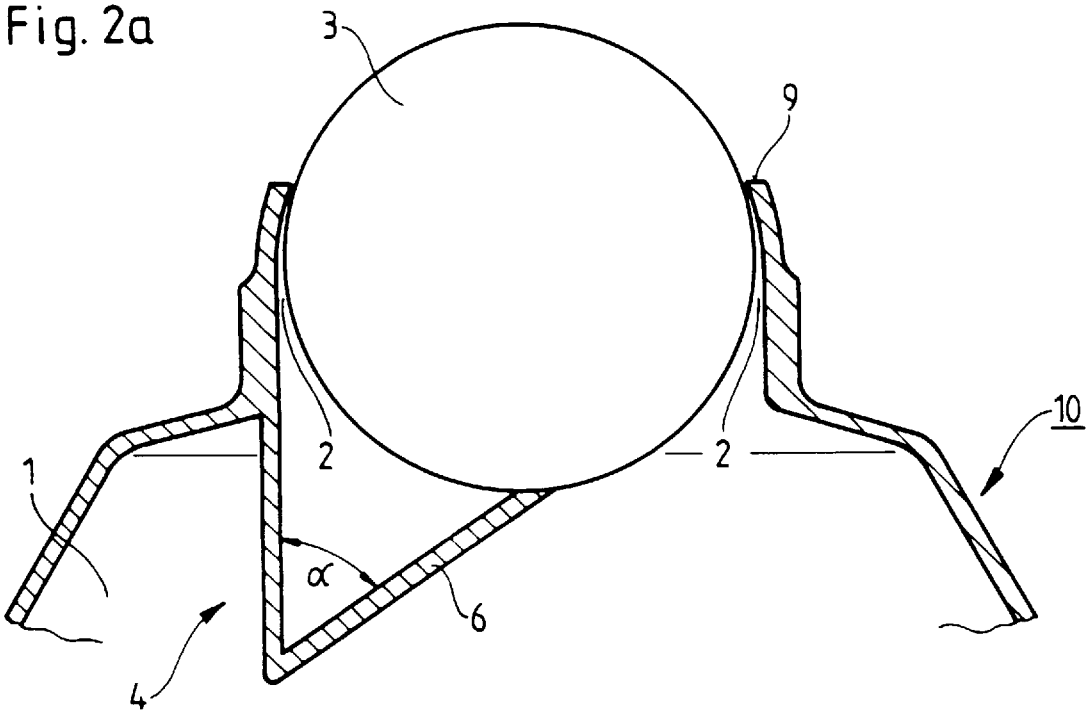
FIGS. 2*a* and 2*b* show containers (shown partially) with other embodiments of the flexible and resilient support means for a ball according to the present invention.
Figure 2B:
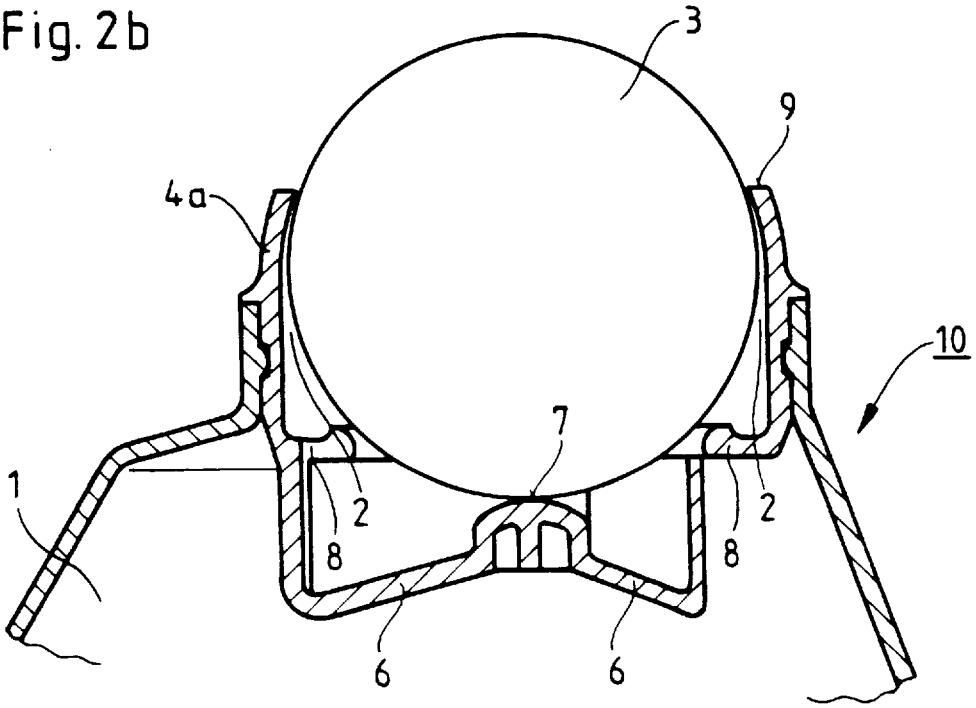
Figure 3:
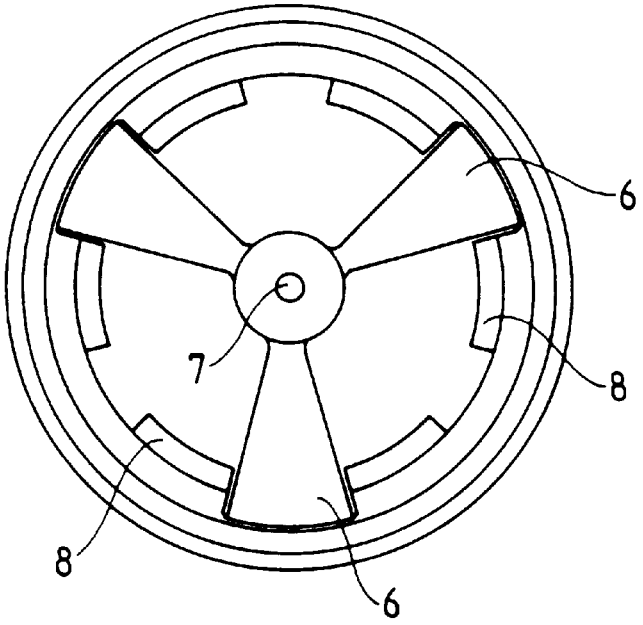
FIG. 3 illustrates the top view of the embodiment of the flexible and resilient support means for the ball of FIG. 2*b*.

As another preferred embodiment according to the present invention, said flexible and resilient support means comprises in the region opposite said dispensing opening at least a resiliently deformable arm (6) urging said ball against said dispensing opening (2) to achieve said leak-tight engagement. Said arm (6) may be bent at an angle $\alpha$ (FIG. 2*a*) to achieve said resilient deformability. Preferably, $\alpha$ is between 0° deg and 90° deg. Preferably, said flexible and resilient support means comprises a housing (4*a*) which fits the container and defines said dispensing opening at one extremity, as illustrated in FIG. 2*b*. The fitment of said housing to said container has to be leak-tight, but said fitment may be threaded or snapped to said container. A threaded fitment of said housing to said container may have the advantage to allow an easy refilling of said container by the user. Therefore, said flexible and resilient support means (4) may be made of a rigid or flexible housing, said housing supporting said spring (5) or said flexible arm (6) and may be inserted into said dispensing opening (2).

As a more preferred embodiment according to the present invention, said flexible and resilient support means (4) may comprise more than one said resiliently deformable arm (6) as in FIG. 2*b*. And as a most preferred embodiment according to the present invention all of said arms are connected together at a ring of contact or single point of contact (FIG. 2*b*, 7) with said ball. Preferably, said single point of contact (7) with said ball is at the point of the ball which is most opposite to said dispensing opening (2).

As a further preferred option, said flexible and resilient support means (4) may comprise, in its region opposite said dispensing opening (2), an interrupted rim (8) against which the ball (3) is urged when an external force is applied. This means that said interrupted rim prevents that said ball is pushed further inside said container. But because said rim is interrupted, i.e. said rim has at least one permanently open passage for the content, the passage for the product flow is guaranteed. Therefore, said interrupted rim defines the maximum product flow passage allowed by said flexible and resilient support means. Furthermore, said interrupted rim impedes that said ball is pushed further inwards with the risk to break said spring of said flexible and resilient support means.

Said flexible and resilient support means (4) may be an integral part to or separated part to said container (10). Said flexible and resilient support means may be made of injection resins (like, for example, polypropylene, polyethylene, polyamide, polyoxymethylene) or elastomeric polymers like thermoplastic elastomers (for example, polyurethane rubber, isoprene rubber, styrene-butadiene rubber) or a combination thereof. Furthermore, two or more stage injection of materials may be used to achieve a flexible and resilient support means having, for example, an elastic spring combined with a rigid attachment feature.

FIG. 4 illustrates a possible embodiment according to the present invention, i.e. a dosing and/or dispensing device able to be placed inside a washing machine adapted for pretreatment. The pretreatment means comprising said flexible and resilient support means (4) with said ball (3) is located in the bottom part of the device (10). Another permanently open filling and dispensing opening (12) is on the top part of the same device. This dosing and/or dispensing device has said pretreatment means located in the bottom part. Therefore, the level of the contained product is always above said pretreatment means. Therefore, the contained product comes automatically in contact with said ball (3), since the minimum level of the content is always higher than said dispensing opening (2). In this manner, the liquid product needs not to be poured towards said dispensing opening, so that this device remains in a horizontal position during the pretreatment operation. Thus this arrangement provides an easy measuring and/or controlling of the amount of liquid detergent applied onto the fabrics during the pretreatment. The measuring and/or controlling can be further facilitated by the dosing lines (11). Nevertheless, the pretreatment means can be easily located on the top part of device nearby the other filling and dispensing opening (12).

Gripping means (FIG. 4, 14) can also be provided in form of cavities, depressions or striations on the external surface of the hollow body (1). They facilitate in holding or even squeezing the device for the pretreatment. This type of means is easy to produce during the moulding of the body of the device. Specific dimensions or shapes of the device in general can be selected by any person skilled in the art.

We claim:

1. A container (10) adapted to contain and dispense a product, said container comprising a hollow body (1), a filling opening (12), a dispensing opening (2), a ball (3) and a flexible and resilient support means (4) for said ball, wherein said flexible and resilient support means urges said ball against said dispensing opening, achieving a leak-tight engagement between said ball and said dispensing opening, said flexible and resilient support means can be resiliently deformed by an external force acting on said ball whereby said leak-tight engagement between said ball and said dispensing opening is disengaged, allowing said contained product to be spread by said ball, said flexible and resilient support means (4) comprises a housing which fits the container and defines said dispensing opening at one extremity, and said housing comprising, in the region of the opposite extremity to said dispensing opening, at least a resiliently deformable arm (6) urging said bass against said dispensing opening (2) to achieve said leak-tight engagement and an interrupted rim (8) against which the ball (3) is urged when an external force is applied.

2. A container (10) according to claim 1 wherein said flexible and resilient support means (4) comprises a spring (5) located under said ball (3), said spring pressing said ball (3) against said dispensing opening (2) to achieve said leak-tight engagement during the periods of non-use of said container.

3. A container (10) according to claim 1 wherein said flexible and resilient support means (4) comprises more than one of said arm (6) and all of said arms are connected together at a point of contact (7) with said ball.

4. A container (10) according to claim 3 wherein said point of contact (7) is at the point of the ball (3) which is most opposite to said dispensing opening (2).

5. A container (10) according to claim 1 wherein the lip (9) of said dispensing opening is deformable.

6. A container (10) according to claim 1 wherein said flexible and resilient support means is made of a material selected from the group consisting of: injected resins, elastomeric polymers and a combination thereof.

7. A container (10) according to claim 1 wherein said container is made of a rigid or flexible material.

8. A container (10) according to claim 1 wherein said container can be a bottle or a tube.

9. A container (10) according to claim 1 wherein said container can be a dosing and/or dispensing device.

10. A container (10) according to claim 1 wherein said ball (3) is spherically shaped.

* * * * *